United States Patent [19]

Carter

[11] Patent Number: 4,894,994

[45] Date of Patent: Jan. 23, 1990

[54] SEALED HEAT ENGINE

[76] Inventor: Lonnie S. Carter, P.O. Box 544, Ashland, Kans. 67831

[21] Appl. No.: 196,295

[22] Filed: May 20, 1988

[51] Int. Cl.[4] ..... F01K 25/10

[52] U.S. Cl. ..... 60/671; 60/651

[58] Field of Search ..... 60/650, 682, 641.6, 60/671

[56] References Cited

U.S. PATENT DOCUMENTS

| | | | |
|---|---|---|---|
| 3,750,393 | 8/1973 | Minto et al. | 60/671 X |
| 3,953,971 | 5/1976 | Parker | 60/641.6 |
| 4,022,024 | 5/1977 | Abeles | 60/682 X |
| 4,157,014 | 6/1979 | Clark, Jr. | 60/682 X |
| 4,187,686 | 2/1980 | Pommier | 60/641.6 |

*Primary Examiner*—Allen M. Ostrager

*Attorney, Agent, or Firm*—William J. Miller

[57] ABSTRACT

A sealed cycle gaseous medium engine comprising a device capable of receiving atmospheric heat (solar or other), converting said heat through a heat exchange system into a pressurized working medium, i.e. $CO^2$ or freon, and, using valves, rectifying this output to a receiver system, thus developing a pressurized gaseous medium capable of operating pneumatic motors, refrigerating equipment, etc.

2 Claims, 1 Drawing Sheet

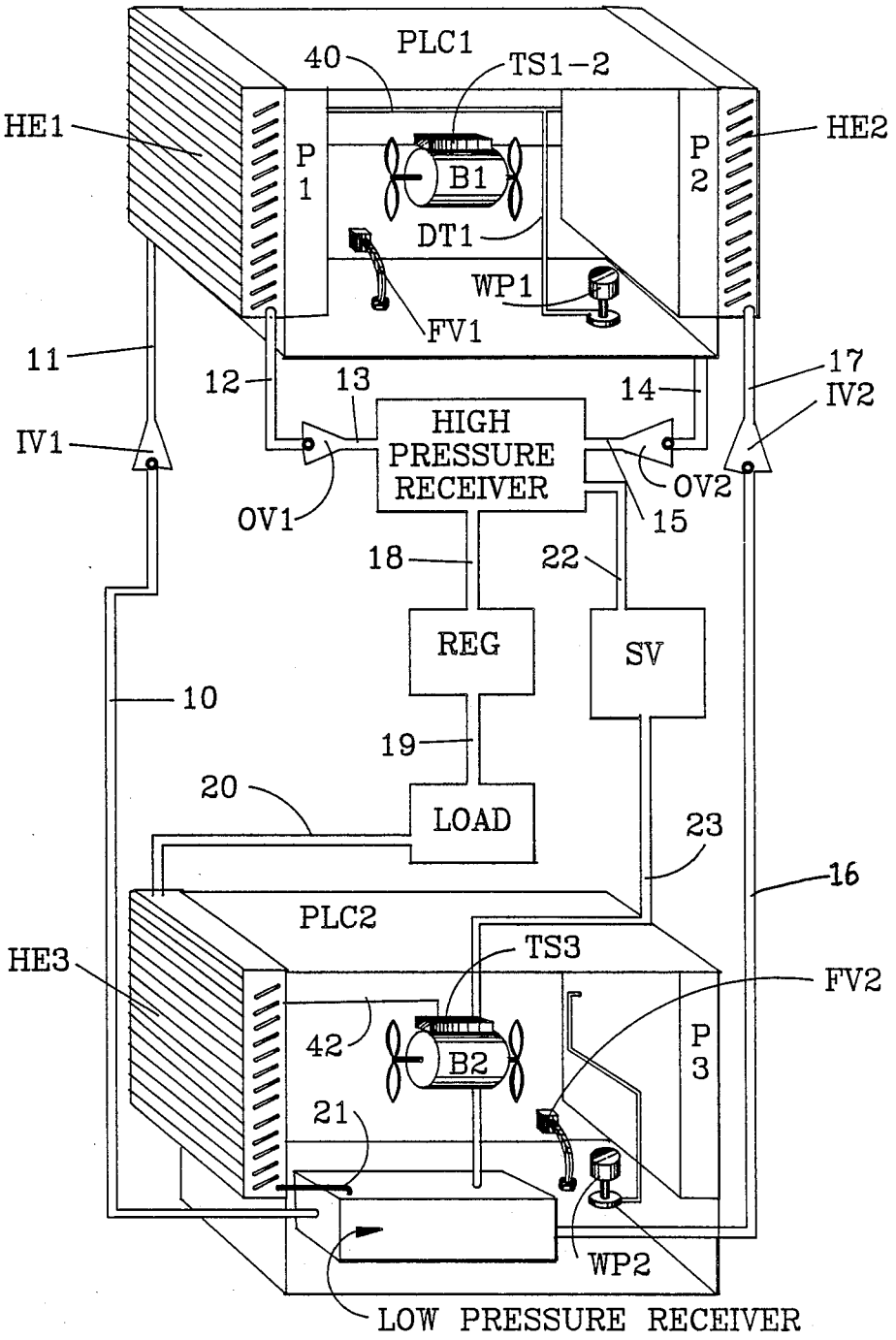
PLC1
40
TS1-2
HE1
HE2
P 1
P 2
B1
DT1
WP1
FV1
11
12
13
14
17
IV2
IV1
HIGH PRESSURE RECEIVER
OV1
OV2
15
18
22
REG
SV
10
19
20
LOAD
23
16
PLC2
TS3
HE3
FV2
42
B2
P 3
21
WP2
LOW PRESSURE RECEIVER

SEALED HEAT ENGINE

SUMMARY OF THE PRESENT INVENTION

A primary object of the present invention is to develop a system of prime movers by which pollution problems are minimized.

A further object of this invention is to utilize natural renewable energy sources previously neglected.

Another object of the present invention is to develop an energy source capable of independent operation.

Another object of the present invention is to utilize low temperature energy sources.

Another object of the present invention is to utilize waste heat energy sources.

IN THE DRAWING

The drawing illustrates a Sealed Heat Engine using $CO^2$ as a gaseous medium with multiple heat exchanges and valving thus permitting simultaneous charging and generating functions.

DESCRIPTION OF THE INVENTION

The invention consists of a sealed cycle gaseous medium heat engine, the parts of which are shown in the drawing consists of Plenum Chambers PLC1 and PLC2. PLC1 and PLC2 are in fact closed chambers but are depicted as open on the viewers side to show detail. Inside PLC1 are located evaporative cooling pads P1 and P2, blower fan assembly B1, fill valve FV1, water pump WP1, and temperature sensors TS1 and TS2 which are connected to HE1 and HE2 by thermocouple wires 40 and 41. WP1 is operative to provide water through distributing tube DT1 to cooling pads P1 and P2. Fill valve FV1 is connected to an external water supply and is operative to provide a reservoir of cooling water in the bottom of PLC1. Adjacent to PLC1 are heat exchangers HE1 and HE2. PLC2 contains the low pressure receiver and low pressure receiver heat exchanger HE3 as well as blow fan assembly B2, water pump WP2, fill valve FV2 which is connected by thermocouple wire 42 to HE3, as well as temperature sensor TS3, and evaporative cooling pad P3. Fill valve FV2 is operative to provide cooling water to a reservior in the bottom of PLC2. WP2 is operative to provide water through distributing tube DT2 to the cooling pad P3. Inlet valve IV1 is a spring loaded ball valve operative to allow liquid $CO^2$ to pass from the low pressure receiver through tube 10 through IV1 through tube 11 to the inlet side of HE1. Outlet valve OV1 is a spring loaded ball valve operative to allow gaseous $CO^2$ to pass from HE1 through tube 12, OV1, and tube 13 to the high pressure receiver. Inlet valve IV2 is a spring loaded ball valve operative to allow liquid $CO^2$ to pass from the low pressure receiver through tube 16, IV2, and tube 17 to the inlet side of HE2. Outlet valve OV2 is a spring loaded ball valve operative to allow gaseous $CO^2$ to pass from HE2 through tube 14, OV2, tube 15 to the high pressure receiver. Safety valve SV between tube 22 and 23 is operative to permit the venting of unwanted high pressures between the high pressure receiver and the low pressure receiver or to the atmosphere in the case of dangerously high overall system pressure. Connected by tube 18 through a regulator and tube 19, is a load comprised of a pneumatic vane-type motor of a type and size appropriate to the pressure volume of the particular sealed heat engine being used. It is connected by tube 20 to HE3 then being connected to the low pressure receiver by tube 21. Cooling pad P3 is operative to provide cooling to heat exchanger HE3.

DESCRIPTION OF OPERATION

Given an ambient temperature of 90° F. the system pressure will be equalized at 1040 psi throughout the system; therefore, no pressure differential exists within the system and; therefore, the system is inoperative. To begin operation, the water pump WP2 and fan B2 in the cooling stage of PLC2 for the low pressure receiver heat exchanger, labeled HE3, is turned on by temperature sensor TS3. This cools the low pressure receiver approximately 17°-18° below ambient temperature thus reducing the pressure in the low pressure receiver and HE3 to approximately 804 psi. At this pressure/temperature combination $CO^2$ becomes liquid in the low pressure receiver stage thus providing means of liquid charging HE1. To begin the gas generation cycle fan B1 and water pump WP1 in PLC1 are turned on by TS1. This causes hot air to be drawn through HE1 and cool air to be blown through HE2. HE2 will be cooled to a temperature approximately 20° below ambient causing a pressure differential of 40 psi lower than the low pressure receiver. The 40 psi differential will cause liquid to flow through inlet valve IV1 and tube 10 and 11 to HE1. Thus the initial charging of HE1 is accomplished. When the temperature in HE1 has been reduced to appropriate charging level TS1 will cause reversal of blower B1, thus causing hot air to be blown through HE1 and cool air through HE2, thus HE2's temperature will be reduced initiating the charging cycle on HE2. At the same time HE1's generating cycle will begin as the heat from the air being drawn through HE1 causes the liquid $CO^2$ to be transformed into gas at a pressure of 1040 psi which will pass through OV1 and associated cooling tubes 12 and 13 to the high pressure receiver. When the appropriate cooling temperature on HE2 has been reached liquid charging will be accomplished through IV2 and tubes 16 and 17. When charging is complete TS2 will cause reversal of blower B1 thus heating air will be blown through HE2 and cooling air through HE1. HE2 will thus begin to generate while HE1 is returned to the initial charging stage. This completes one cycle of the Sealed Heat Engine, S.H.E. operation. It thus follows that one heat exchanger is always in a charging stage while the other is in the gas generation stage. The pressure thus generated between high and low pressure receivers should be approximately 235 psi continuously when using $CO^2$ at 90° F. ambient. Thus the load and associated tubes 18, 19, regulator, tube 20, HE3 and tube 21 connected between high and low pressure receivers provides the means of producing useful work in proportion to the pressure volume of the gases generated. Load is comprised of a pneumatic vane-type motor of a type and size appropriate to the pressure volume of the particular S.H.E. being used. This pneumatic motor is used in conjunction with a regulator so that a constant speed/load may be maintained. Safety valve SV provides a means of venting unwanted high pressures between the high pressure receiver and the low pressure receiver or to the atmosphere in the case of dangerously high overall system pressure.

This description of operation of the system, given an ambient temperature of 90° F., is much the same for other degrees of ambient temperatures in the range of 50°-120° F. It also follows that if the cooling temperature range accomplished by the cooling pads P1, P2, and P3 is more or less than 20° F. the pressure difference associated with these cooling functions in HE1, HE2, and HE3 will vary accordingly.

Blowers B1 and B2, temperature sensor TS1, TS2, and TS3 are connected to an external electrical source and are operative to move air in the appropriate direction to heat or cool heat exchangers HE1 and HE2 alternately and to cool HE3. Independent operating models would employ a means of manually operating fans B1 and B2 until sufficient pressures are reached and would employ pneumatic motors on B1 and B2, WP1 and WP2 operative to provide fan and water pump power after operating pressures are reached. Temperature sensor on independent models would be pneumatically operated.

When using other gaseous mediums, i.e. freon 502, multiple heat exchangers, the same as HE1 and HE2, and multiple valves would be used as compression stages to obtain suitable working pressures at the operating temperatures previously described.

What is claimed is:

1. A solar apparatus for generating a gas for driving an engine having an inlet and outlet comprising:

(a) first and second plenum means;

(b) a high pressure and a low pressure reservoir means;

(c) liquid to gas conversion means mounted in said first plenum means, said liquid to gas conversion means comprising heat exchange means and an evaporative cooling means, bidirectional fan means and temperature sensing means coupled to said fan means whereby when said fan means is operating in one direction, air will pass through said heat exchange means and through said evaporative cooling means causing said heat exchange means to increase in temperature thereby converting said liquid into a gas and wherein when said heat exchange means reaches a predetermined temperature said fan means is reversed in direction causing air to move through said evaporative cooling means and then said heat exchange means thereby causing said heat exchange means to cool, resulting in liquid moving from said low pressure reservoir means to said heat exchange means so that said cycle can be repeated;

(d) gas to liquid conversion means mounted in said second plenum means;

(e) means coupling said low pressure reservior means to said liquid to gas conversion means;

(f) means coupling said liquid to gas conversion means to said high pressure reservior means;

(g) means for coupling said high pressure reservior means to said inlet of said engine means;

(h) means for coupling said outlet of said engine means to said gas to liquid conversion means and, means for coupling said gas to liquid conversion means to said low pressure reservior means;

whereby said low pressure liquid is converted to a gaseous state and transferred from said high pressure reservior means through said engine means to said low pressure reservoir means.

2. A solar apparatus as described in claim 1 wherein said heat exchange means comprises first and second heat exchange apparatus and wherein said evaporative cooling means comprises first and second evaporative cooling means and wherein said temperature sensing means comprises first and second temperature sensing apparatuses and wherein said low pressure reservior means is coupled to both said first and second heat exchange means, thereby resulting in a continuous generation of high pressure gas as said first and second heat exchange means are alternatively heated and cooled.

* * * * *